US007490802B1

(12) United States Patent
Teng

(10) Patent No.: US 7,490,802 B1
(45) Date of Patent: Feb. 17, 2009

(54) BEAM CLAMP

(76) Inventor: Tino S. Teng, P.O. Box 24-108, Taipei (TW)

( * ) Notice: Subject to any disclaimer, the term of this patent is extended or adjusted under 35 U.S.C. 154(b) by 0 days.

(21) Appl. No.: 11/980,055

(22) Filed: Oct. 31, 2007

(51) Int. Cl.
*A47B 96/06* (2006.01)

(52) U.S. Cl. ..... 248/229.15; 248/229.16

(58) Field of Classification Search ..... 248/229.15, 248/229.25, 228.6, 230.6, 231.71, 229.16, 248/229.26, 228.7, 230.7, 72, 231.81
See application file for complete search history.

(56) References Cited

U.S. PATENT DOCUMENTS

| | | | | |
|---|---|---|---|---|
| 5,823,657 | A * | 10/1998 | Price et al. | 362/191 |
| 6,439,522 | B1 * | 8/2002 | Yeh | 248/231.71 |
| 6,494,411 | B1 * | 12/2002 | Bjorklund | 248/49 |
| 2008/0042027 | A1 * | 2/2008 | LaScala | 248/229.15 |
| 2008/0135691 | A1 * | 6/2008 | Buck | 248/62 |

* cited by examiner

*Primary Examiner*—Ramon O Ramirez

(57) ABSTRACT

A beam clamp having a C-shaped clamp body, which has a threaded through hole on the top side and two parallel vertical cuts on the middle, and a hanging plate, which extends downwardly from the clamp body and suspending between the two parallel cuts and has a hanging hole and a plurality of forwardly and backwardly curved and threaded semicircular flanges alternatively disposed at different elevations for the hanging of a heavy object.

2 Claims, 2 Drawing Sheets

BEAM CLAMP

BACKGROUND OF THE INVENTION

1. Field of the Invention

The present invention relates to clamps and more particularly, to a beam clamp for fastening to a beam for the hanging of a heavy object.

2. Description of the Related Art

Beam clamps are intensively used in construction to suspend heavy objects. Conventional beam clamps are commonly forged from metal. During installation of a beam clamp in a beam, a screw bolt is threaded into the beam clamp and stopped against the periphery of the beam to hold the beam clamp in place. Beam clamps made of metal by forging are commonly heavy and expensive, and may slip easily after installation. There are also known beam clamps directly made from a metal plate by stamping. Beam clamps made of a metal plate by stamping have a low structural strength because of thin wall thickness. These beam clamps have claws for fastening to a beam. During installation of a beam clamp in a beam, screws are used and driven into the beam to fix the beam clamp in position. However, because of thin wall thickness, the depth of the claws in the beam is limited, and the beam clamp may fall from the beam accidentally.

SUMMARY OF THE INVENTION

The present invention has been accomplished under the circumstances in view. According to one aspect of the present invention, the beam clamp comprises a C-shaped clamp body, and a hanging plate. The C-shaped clamp body comprises a through hole formed of a threaded big circular hole and a small circular hole in tangent with the threaded big circular hole, a plurality of barbed protrusions protruded from two distal ends thereof, and two parallel cuts extending downwardly from a middle part thereof, and a hanging plate portion extending from the clamp body and suspending between the two parallel cuts. The hanging plate comprises a hanging hole, a plurality of forwardly and backwardly curved semicircular flanges alternatively disposed at different elevations, and threads formed on the forwardly and backwardly curved semicircular flanges for securing a threaded member.

According to another aspect of the present invention, the clamp body comprises a plurality of reinforcing ribs and recessed portions that reinforce the structural strength of the beam clamp.

DETAILED DESCRIPTION OF THE PREFERRED EMBODIMENT

Figure 1:
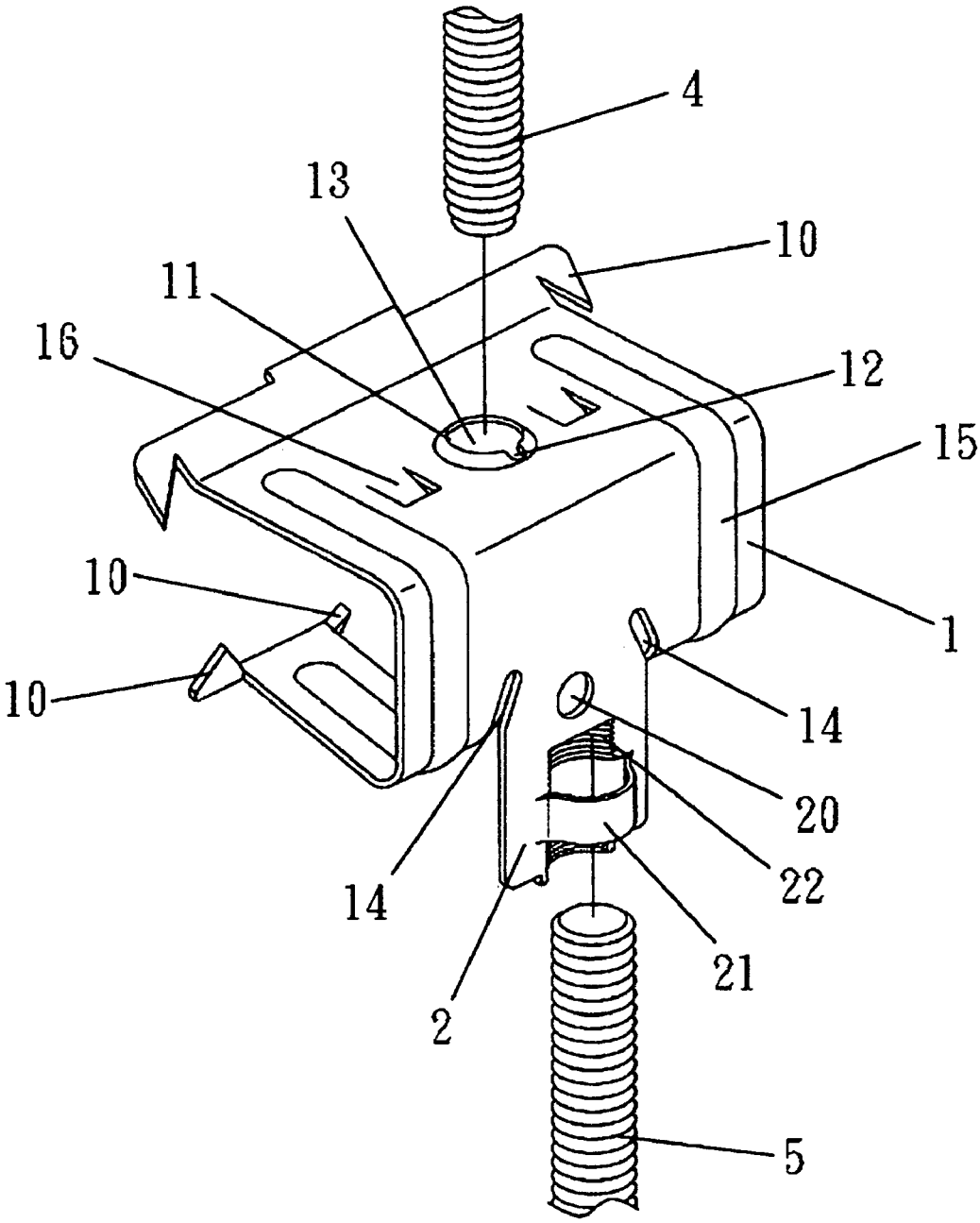
FIG. 1 is an exploded view of a beam clamp in accordance with the present invention.
Figure 2:
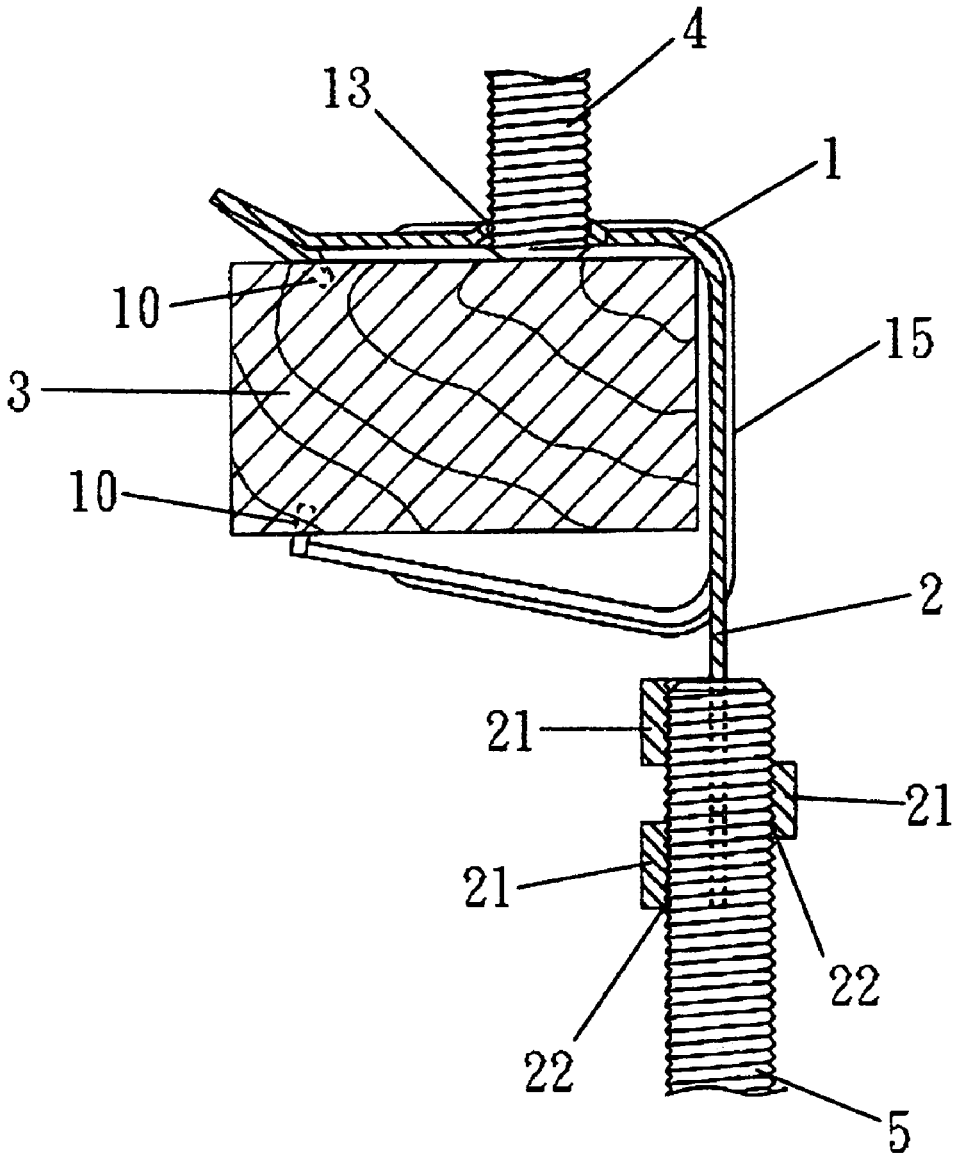
FIG. 2 is a schematic sectional view of the present invention, showing the beam clamp fastened to a beam.

Referring to FIG. 1, a beam clamp in accordance with the present invention is shown comprising a clamp body 1 and a hanging plate 2. According to the present preferred embodiment, the beam clamp is directly made of a metal plate member by stamping. The clamp body 1 has a C-shaped profile, a big circular hole 11 and a small circular hole 12 cut through its top wall, a plurality of barbed protrusions 10 protruded from the ends, a plurality of reinforcing ribs 15 and recessed portions 16 that reinforce the structural strength of the clamp body portion 1, and two parallel cuts 14 extending downwardly from a middle part to its one end at the bottom side. The big circular hole 11 is threaded. The big circular hole 11 and the small circular hole 12 are connected to each other, forming a through hole 13. The hanging plate 2 is formed of a part of the bottom wall of the clamp body 1 and suspending between the two parallel cuts 14, having a hanging hole 20, a plurality of forwardly and backwardly curved semicircular flanges 21 alternatively disposed at different elevations, and threads 22 formed on the inner surface of each of the forwardly and backwardly curved semicircular flanges 21.

When in use, the C-shaped clamp body 1 is attached to the beam 3, and the barbed protrusions 10 are then driven into the surface of the beam 3 to prohibit disconnection of the clamp body portion 1 from the beam 3, and then one screw bolt 4 is threaded into the through hole 13 and stopped against the top surface of the beam 3 to enhance the connection between the clamp body portion 1 and the beam 3. When installed, the hanging hole 20 is provided for the hanging of a heavy object by means of a hook bar or steel rope. A handing bar 5 can be fastened with its threaded end to the threads 22 on the forwardly and backwardly curved semicircular flanges 21 to hand a heavy object.

As stated above, the beam clamp is directly made out of one single metal plate. Therefore, the beam clamp is easy and inexpensive to manufacture.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A beam clamp comprising a C-shaped clamp body, said C-shaped clamp body comprising a through hole formed of a threaded big circular hole and a small circular hole in tangent with said threaded big circular hole, a plurality of barbed protrusions protruded from two distal ends thereof, and two parallel cuts extending downwardly from a middle part thereof, and a hanging plate portion extending from said clamp body and suspending between said two parallel cuts, said hanging plate comprising a hanging hole, a plurality of forwardly and backwardly curved semicircular flanges alternatively disposed at different elevations, and threads formed on said forwardly and backwardly curved semicircular flanges for securing a threaded member.

2. The beam clamp as claimed in claim 1, wherein said clamp body comprises a plurality of reinforcing ribs and recessed portions.

* * * * *